US006805574B2

(12) United States Patent
Huang

(10) Patent No.: US 6,805,574 B2
(45) Date of Patent: Oct. 19, 2004

(54) STRUCTURE FOR THE CONNECTION BETWEEN A HUB AND ITS TRANSCEIVERS

(75) Inventor: Lung-Hua Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/382,885

(22) Filed: Mar. 7, 2003

(65) Prior Publication Data

US 2003/0176091 A1 Sep. 18, 2003

(30) Foreign Application Priority Data

Mar. 15, 2002 (TW) ..... 91203185 U

(51) Int. Cl.[7] ..... H01R 13/627

(52) U.S. Cl. ..... 439/357; 439/352; 361/728; 361/754

(58) Field of Search ..... 439/372, 352, 439/357, 358, 483, 76.1, 160, 310; 361/728, 754, 759, 741, 747; 385/92

(56) References Cited

U.S. PATENT DOCUMENTS 6,430,053 B1 * 8/2002 Peterson et al. ..... 361/728
6,434,015 B1 * 8/2002 Hwang ..... 361/754

* cited by examiner

*Primary Examiner*—Alex Gilman
(74) *Attorney, Agent, or Firm*—Birch, Stewart, Kolasch & Birch, LLP

(57) ABSTRACT

A structure for the connection between a hub and its transceivers for installing a transceiver in a connection port of the hub is provided. The connection structure includes a fastener installed in a transceiver, a stopper installed in the hub for coupling with the fastener, and a releaser for separating the fastener and stopper. There is a button-style releaser with an applied end that reaches the front of the hub for separating the transceiver from the hub when the applied end is pressed.

19 Claims, 11 Drawing Sheets

STRUCTURE FOR THE CONNECTION BETWEEN A HUB AND ITS TRANSCEIVERS

FIELD OF THE INVENTION

The invention is related to a structure for a hub, and more particularly to a structure for the connection between the hub and its transceivers.

BACKGROUND OF THE INVENTION

In a Local Area Network (LAN) characterized by asteroid topology, a twisted-pair cable usually links up the nodes for information transmission, while a hub connects each computer to the server or generates new signals. Most of the known hubs includes several connection ports for receiving the communication module, such as transceivers of RJ-45 connectors or transceivers composed of photoelectric reception and emission components.

All known combinations of transceivers and a hub are based on an assembly-disassembly design. FIG. 1 shows a conventional transceiver. While taking this transceiver from a hub, a user has to press a slider 10 located at the top of the front of the transceiver for separating the transceiver from the hub. However, once it is pushed and moved forward, the slider 10 will not return to the previous locking position by itself. A drawback of the design is that, if the transceiver is pushed into the connection port of the hub again, the slider 10 will not lock the transceiver in the connection port of the hub properly.

The above-described design still has another drawback. The aforesaid known slider 10 is disposed on the lateral side near the front end of the transceiver, but not extended out of the front of the transceiver. If the transceivers are arranged in pairs and aligned in two rows, that is, each pair of transceivers are put together in a mirror-like (or back-to-back) manner before being pushed into the hub, then the slider will not work. Alternatively, increasing the gap between a pair of transceiver might solve this problem, but it will increase the volume of the hub.

THE OBJECT AND SUMMARY OF THE INVENTION

The primary object of the invention is to improve the structure for the connection between a hub and its communication modules (such as transceiver), and provide a connection structure for easy assembly and disassembly.

The solution put forth by the invention involves re-designing the releaser. In the first embodiment, the releaser is slidably installed in the transceiver. The releaser has an applied end protruding from one end of the transceiver. After the transceiver has been inserted into the connection port of the hub, the applied end is still positioned out of the front of the hub. A user may remove the transceiver from the hub easily by pressing the releaser in front of the hub.

In another preferred embodiment of the invention, the lever-style releaser has applied end exposed out of the front of the transceiver. To remove the transceiver from the hub, a user can press the applied end, so as to move a fastener for disassembling the transceiver from the hub.

Another object of the invention is to reduce the size of hub. Since the releaser is not positioned on the side of the transceiver, the size of hub will be reduced and the transceivers can be easily installed or removed, whereas pairs of transceivers may be inserted into a hub in a mirror-like (or back-to-back) manner and be aligned in two rows.

The explanations and illustrations of the preferred embodiments and a detailed description of the technique for the invention are as follows:

DETAILED DESCRIPTION OF THE PREFERRED EMBODIMENTS

The First Embodiment

Figure 1:
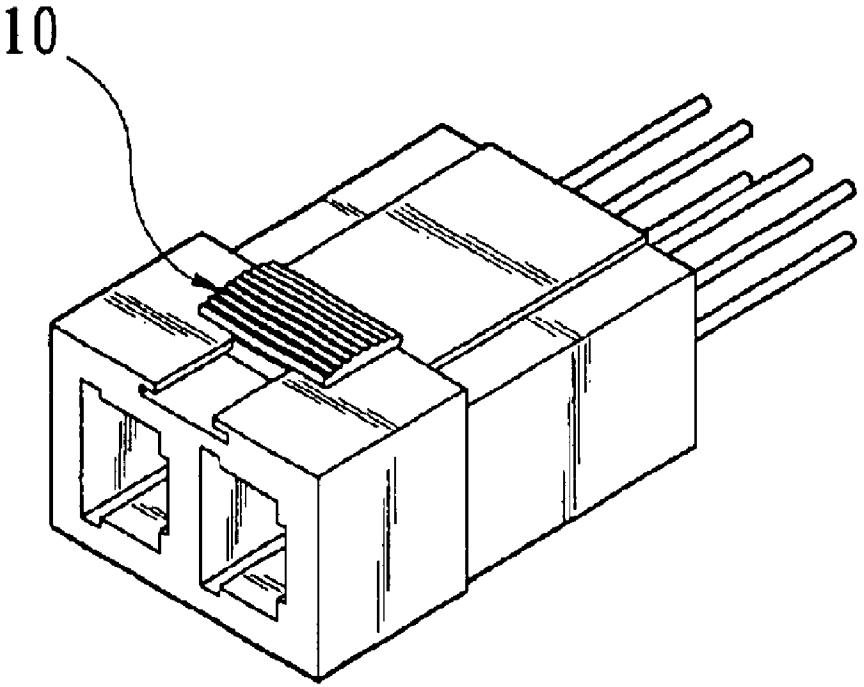
FIG. 1 (PRIOR ART)
FIG. 1 depicts a conventional transceiver.
Figure 2:
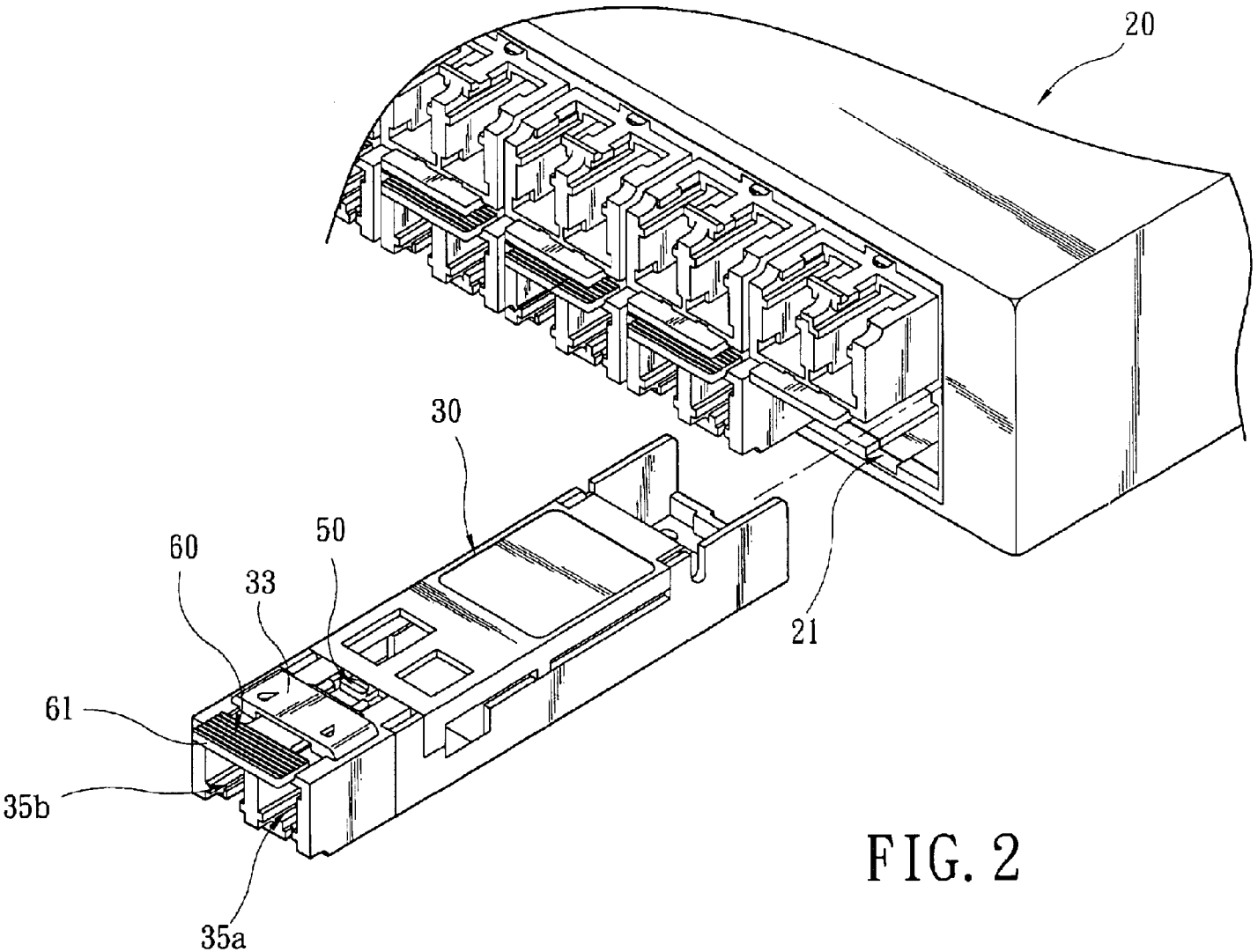
FIG. 2 depicts the first embodiment of the invention.

FIG. 2 depicts the structure of the hub 20 and its communication module (exemplified by a transceiver 30 in the figure) for the first embodiment of the invention. The hub 20 has several connection ports 21 arranged in two rows. This kind of transceiver 30 is, basically, a transceiver having a receiver 35*a* and a transmitter 35*b* for connecting an input optical fiber and an output optical fiber, respectively.

Figure 3:
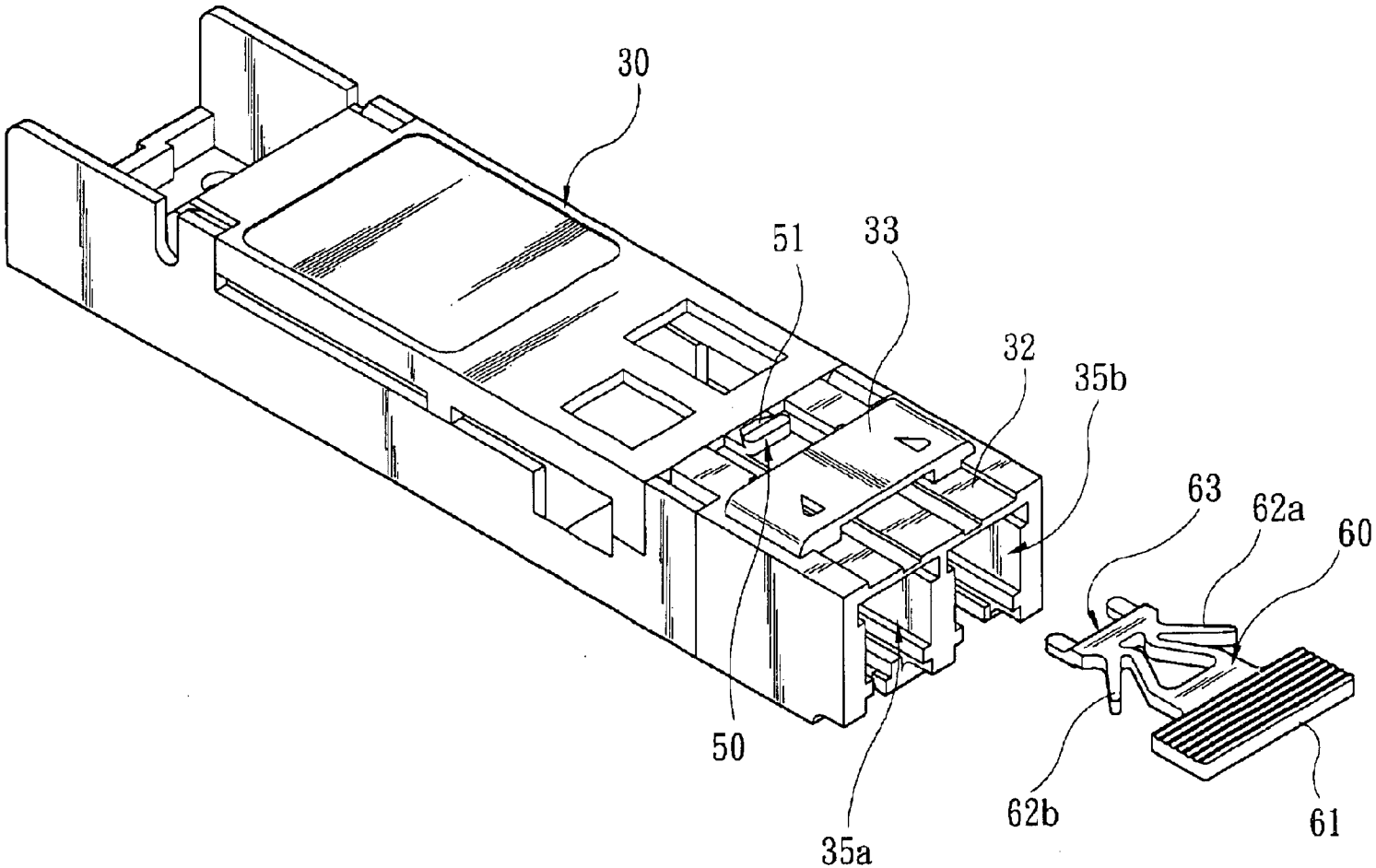
FIG. 3 depicts the structure of a transceiver for the first embodiment of the invention.

The connection structure put forth by the invention includes a stopper 40 installed inside the connection port 21 of the hub 20 (see FIG. 6A), wherein one end of the stopper 40 is fixed in the hub 20 and the other free end 41 is flexible and extends obliquely toward the transceiver 30; a fastener 50 fixed in the transceiver 30 for being engaged with the free end 41 of the stopper 40 after the transceiver 30 has been inserted into the connection port 21 (see FIG. 6A), so that the transceiver 30 will be fixed in the connection port 21 of the hub 20; and a releaser 60 installed on the external side of the transceiver 30. The releaser 60 can slide between the assembling position (see FIG. 6A) and the disassembling position (see FIG. 6B). The releaser 60 includes an applied end 61 and a pair of flexible wings 62*a* and 62*b* (see FIGS. 3 & 4). The ends of the pair of wings (see FIG. 6A) extend obliquely along the direction opposite to the insertion direction of the transceiver 30 into the connection port 21. The ends of the pair of wings 62*a* and 62*b* can be coupled with the notches 31*a* and 31*b* on the surface of the transceiver 30, respectively. Owing to the elasticity of the pair of wings 62*a* and 62*b*, the releaser 60 is kept in the assembling position in a normal state. There is a surface 63 on the side of the head of the releaser 60 facing the stopper 40. The surface 63 can contribute to detach the free applied end 41 of the stopper 40 from the fastener 50 (see FIG. 6B). As a result, a user may remove the transceiver 30 from the connection port 21 of the hub 20.

Figure 6A:
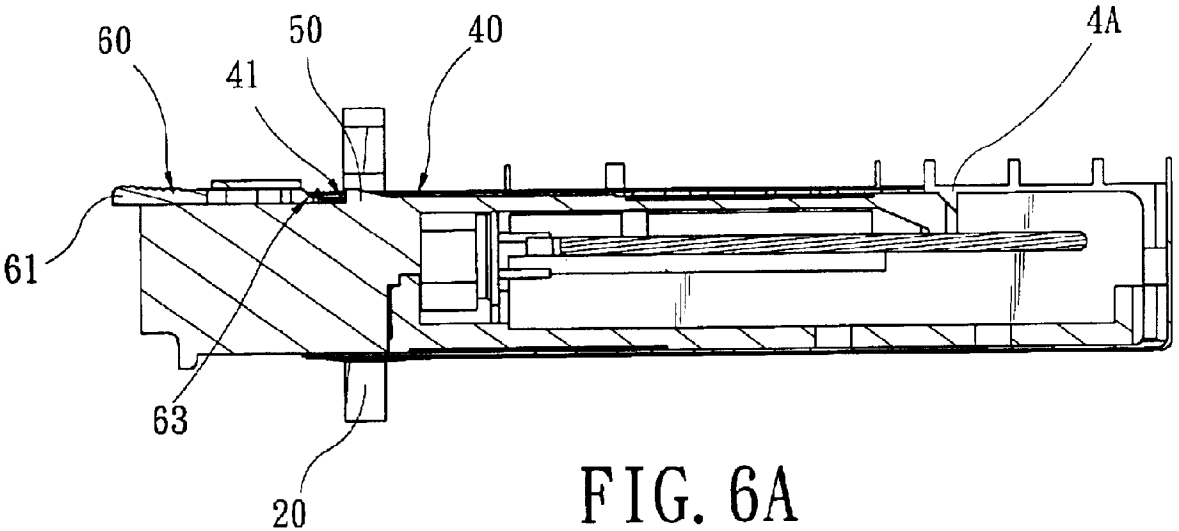
FIGS. 6A & 6B are the cross-sectional diagrams for the structure of the transceiver in the first embodiment.
Figure 6B:
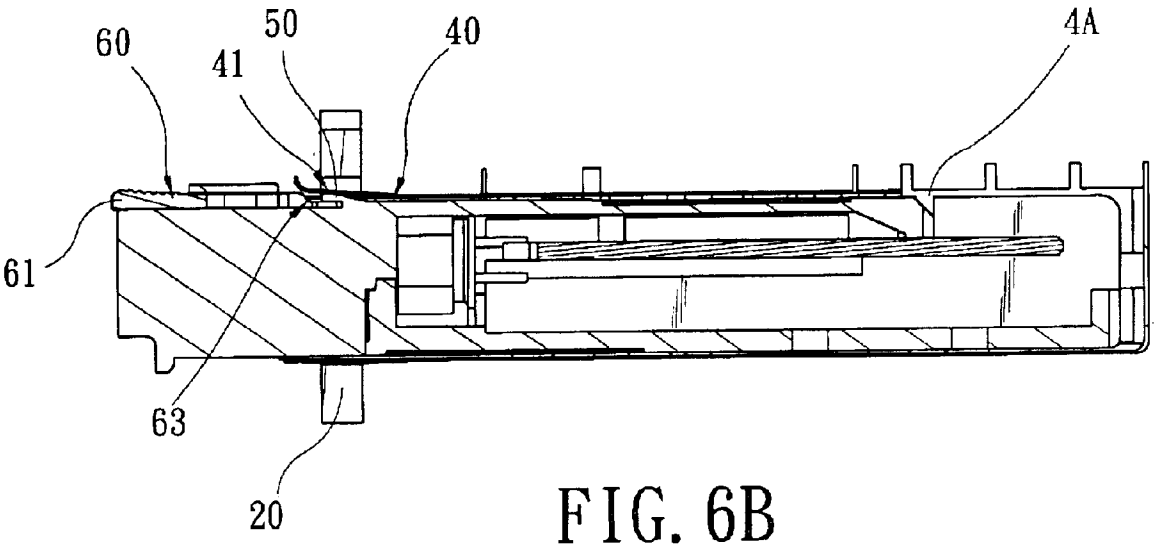

In the embodiments disclosed by the invention, the aforesaid stopper 40 is, in fact, a part of a metallic housing 4A that encloses the transceiver 30 (see FIG. 6A). This metallic housing 4A not only has the functions of electrical grounding and shielding from electromagnetic interface, but also contributes to the combination of a hub 20 and its transceiver 30. Hence, a metallic resilient element can be formed on the metallic housing 4A and extend outwards from the transceiver 30 as the aforesaid stopper 40. In the preferred embodiment, a hook is formed on the free end 41, and a hole 411 is made on the surface of the stopper 40 for locking the fastener 50.

Figure 4:
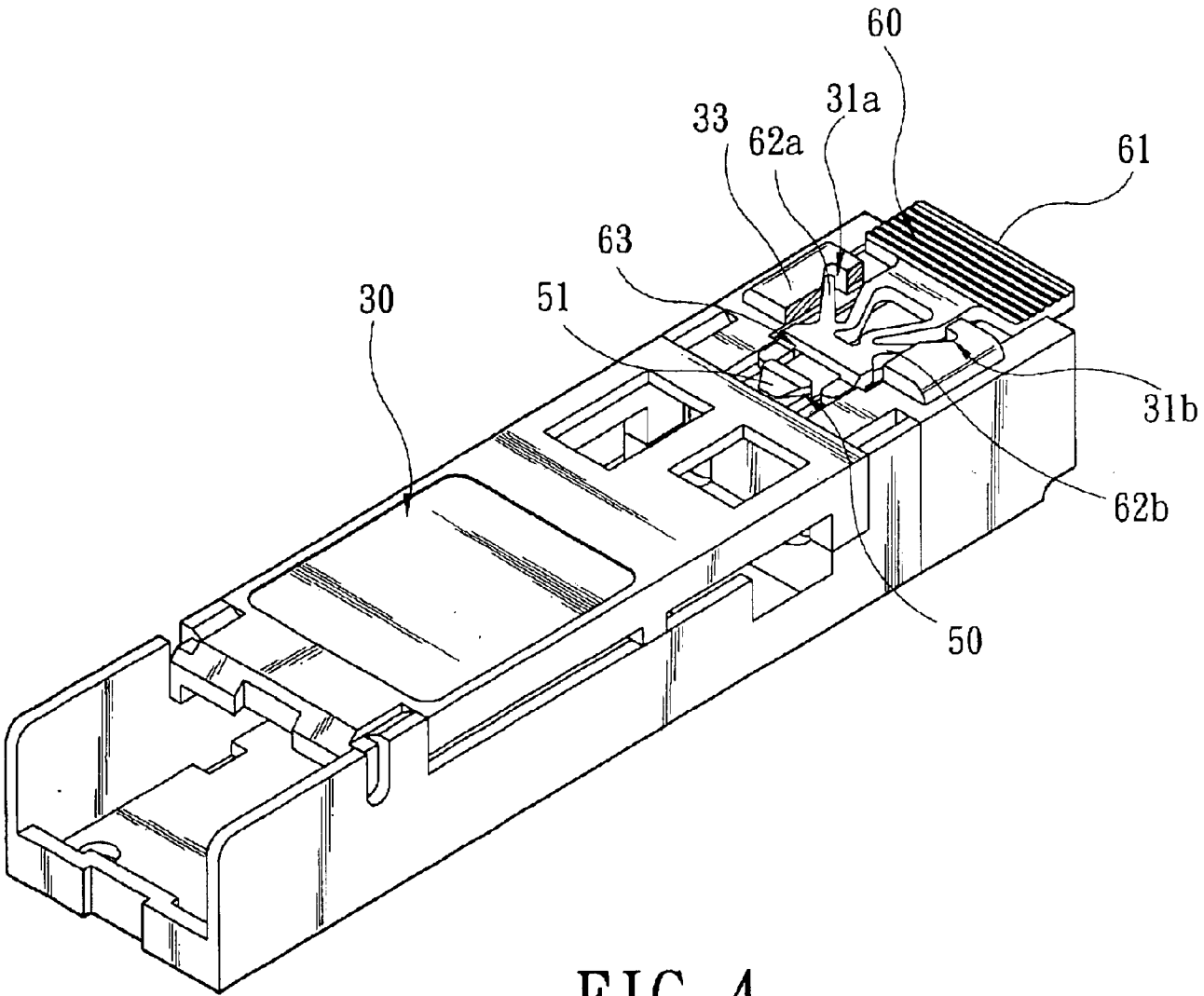
FIGS. 4 & 5 illustrate how a releaser works.
Figure 5:
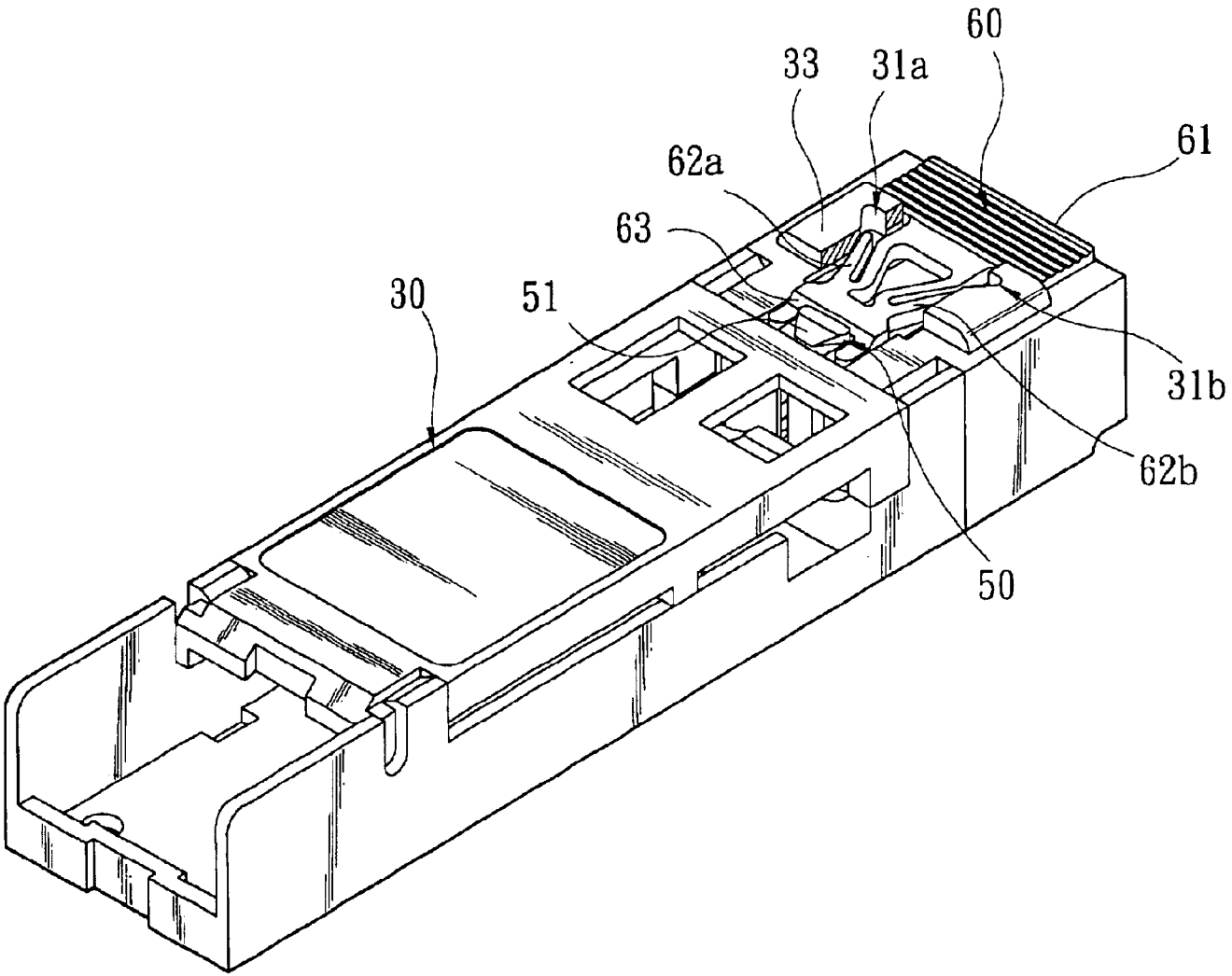

The releaser 60 is a flat component. It is inserted into a groove 32 found on the surface of the transceiver 30 and restricted by a cover 33 fixed to the top of the groove 32 so that it can only slide along the groove 32. As shown in FIG. 4, the ends of the wings 62*a* and 62*b* can be coupled with the notches 31*a* and 31*b*, respectively, formed on the surface of the transceiver 30. In the normal state, the releaser 60 is not pushed against, and there is a gap between the surface 63 on the head of the releaser 60 and the fastener 50. However, once the transceiver 30 is inserted into the connection port 21 of the hub 20, the free end 41 of the stopper 40 will urge against the fastener 50 from the gap (see FIG. 6A). While disassembling the transceiver 30 from the connection port 21 of the hub 20, the user may apply a force on the applied end 61 of the releaser 60, and push the surface 63 toward the fastener 50 until it reaches the disassembling position (see FIG. 5). As shown in FIG. 5, when the releaser 60 reaches the assembling position, the wings 62*a* and 62*b* deform under the squeeze of the groove 32. With the resilient force generated by the deformity of the wings 62*a* and 62*b*, the releaser 60 returns to the normal position.

In the first embodiment, the fastener 50 is a kind of protuberance fixed on the external surface of the transceiver 30. There is an oblique surface 51 on the side of the fastener 50 facing the stopper 40. The oblique surface 51 can slide beneath the stopper 40 when the fastener 50 is inserted into the hub 20 along with the transceiver 30.

The Second Embodiment

Figure 7:
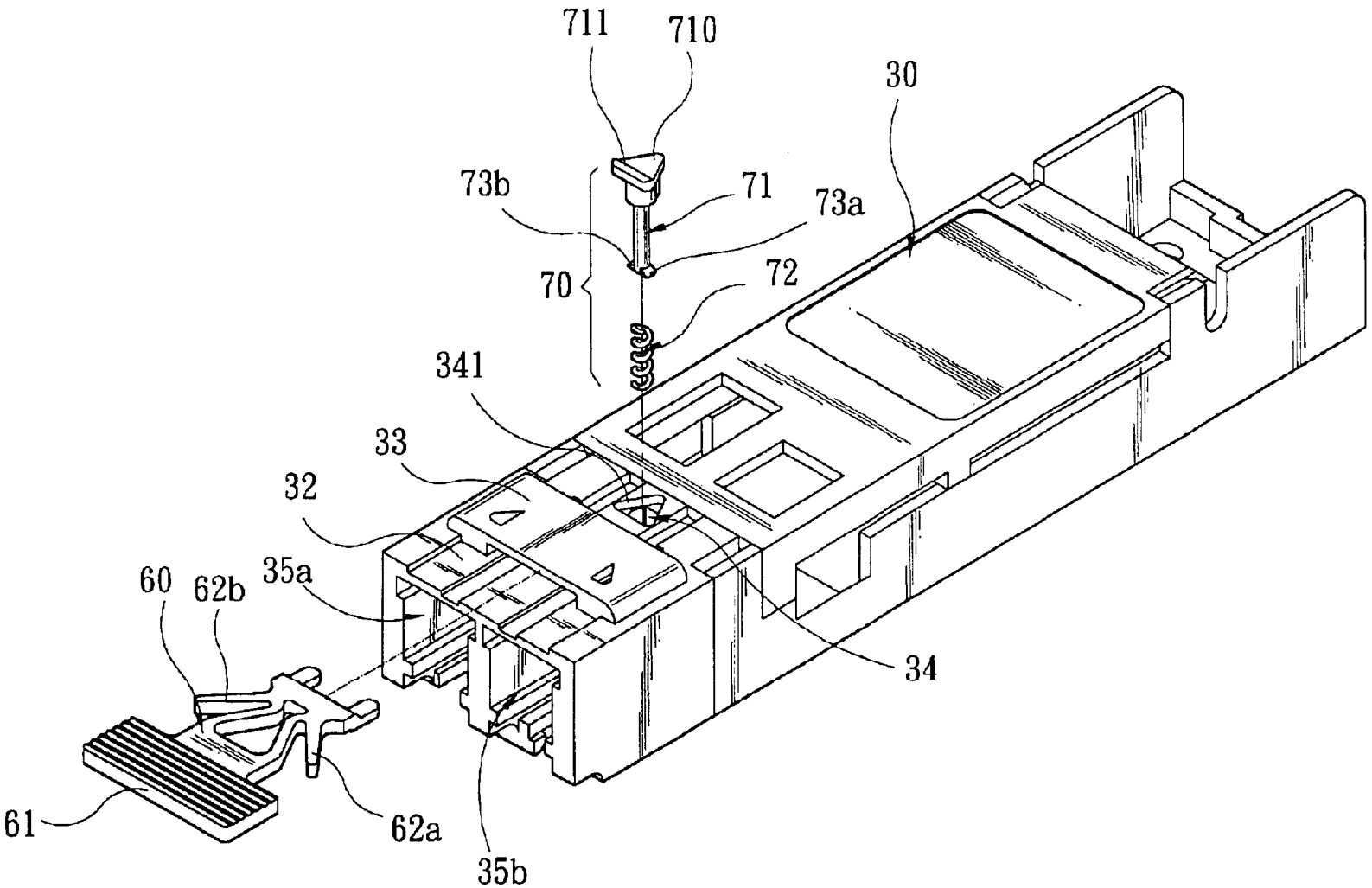
FIG. 7 depicts the second embodiment of the invention.
Figure 8:
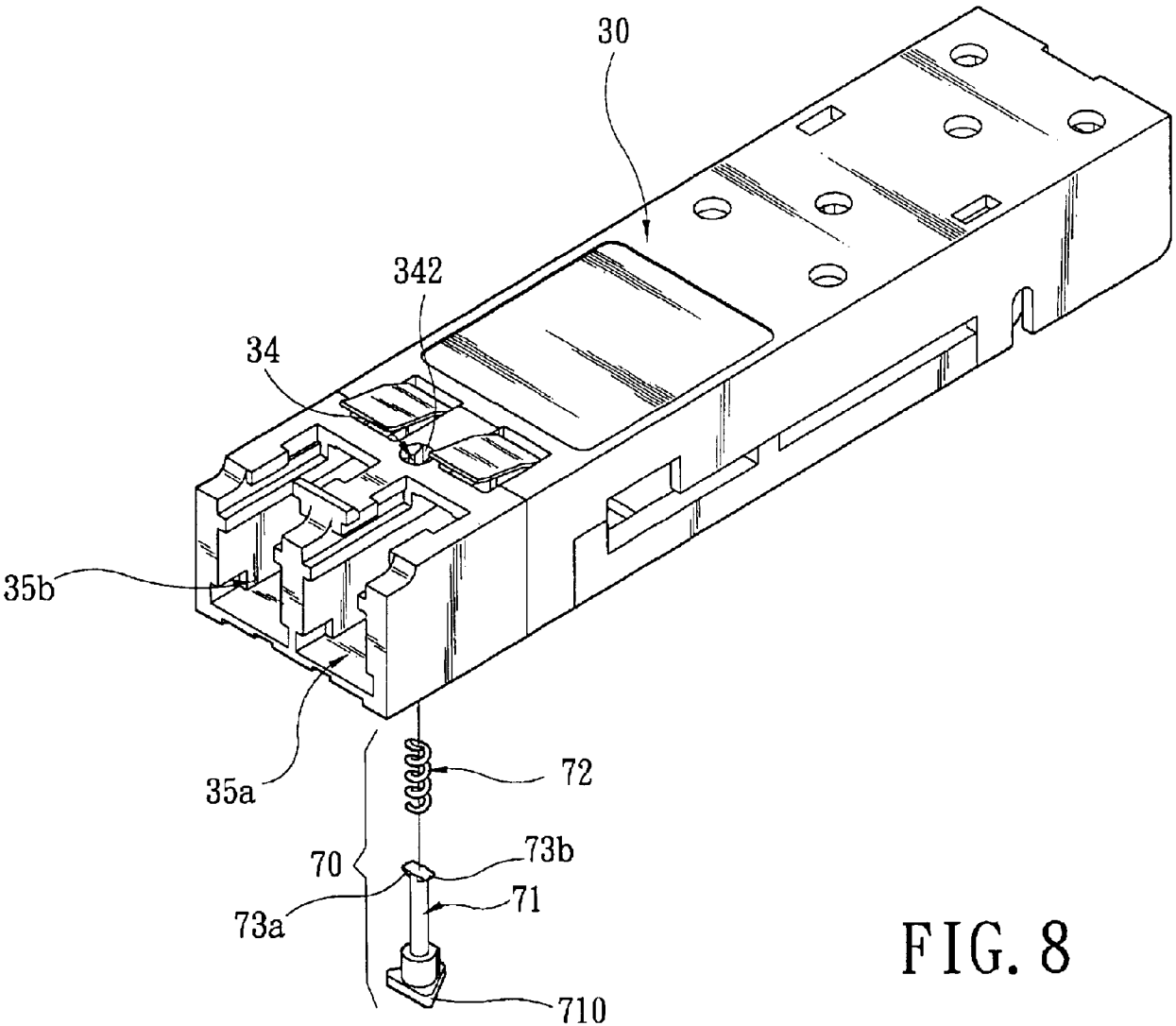
FIG. 8 is a rear view of the transceiver shown in FIG. 7.

The second embodiment of the invention is characterized by a modification of the fastener 50 put forth in the first embodiment. The second embodiment involves a movable fastener 70. FIGS. 7 & 8 depict the structure of the movable fastener 70.

The movable fastener 70 includes an elongated body 71 that may be inserted into or stuck out from the transceiver 30, as well as a spring 72. In the normal state, the spring 72 can raise the head 710 of the elongated body 71 so that the free end 41 of the stopper 40 stops it after the transceiver 30 has been inserted into the connection port 21.

There is an oblique surface 711 (or an arc-shaped surface) on the side of the head 710 of the elongated body 71 facing the stopper. The oblique surface 711 is slidable beneath the stopper 40 when the fastener 70 is inserted into the hub 20 along with the transceiver 30, as shown in FIGS. 9A and 9B.

A through hole 34 is pierced in the transceiver 30. By increasing the size of the head 710, the head 710 of the elongated body 71 can only be inserted into or stick out from a relatively bigger recess 341 at one end of the through hole 34. Protuberances 73*a* and 73*b* are formed on both sides of the other end of the elongated body 71. The spring 72 is telescoped on the elongated body 71 and positioned between the head 710 and the protuberances 73*a* & 73*b*. As shown in FIG. 8, there is a slit 342 on the inner wall of the other end of the through hole 34. The slit 342 is characterized by radial widening. As a result, protuberances 73*a* & 73*b* can only pass through the slit 342, if aligned. By rotating the elongated body 71, the protuberances 73*a* & 73*b* can engage with the slit 342 such that the elongated body 71 and the spring 72 can be installed in the transceiver 30. With the elasticity of the spring 72, the head 710 of the elongated body 71 may be lifted in the normal state.

Figure 9B:
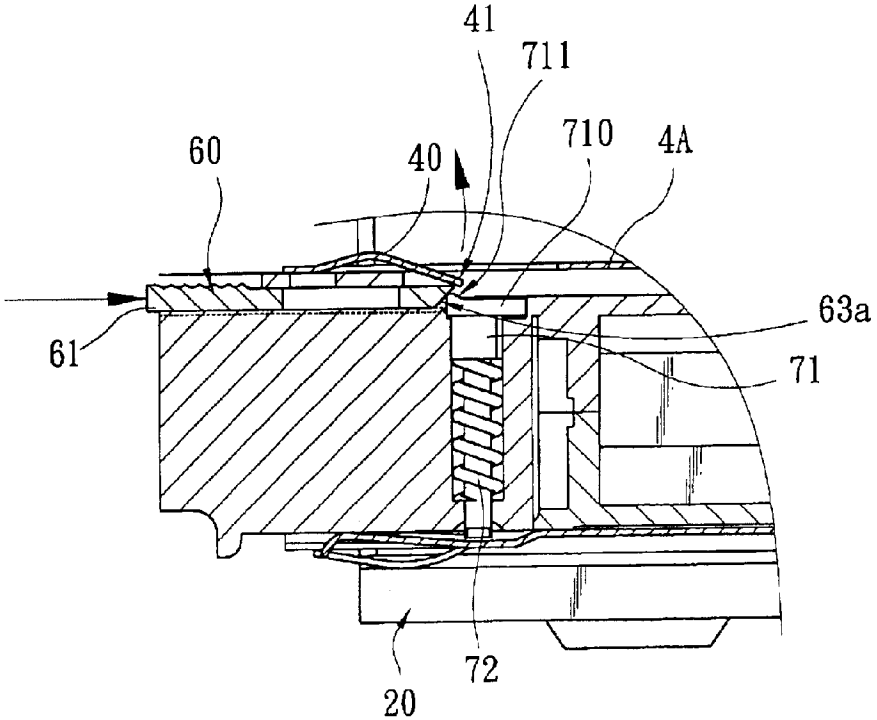
FIGS. 9A & 9B are the cross-sectional diagrams for the structure of the transceiver in the second embodiment.
Figure 9A:
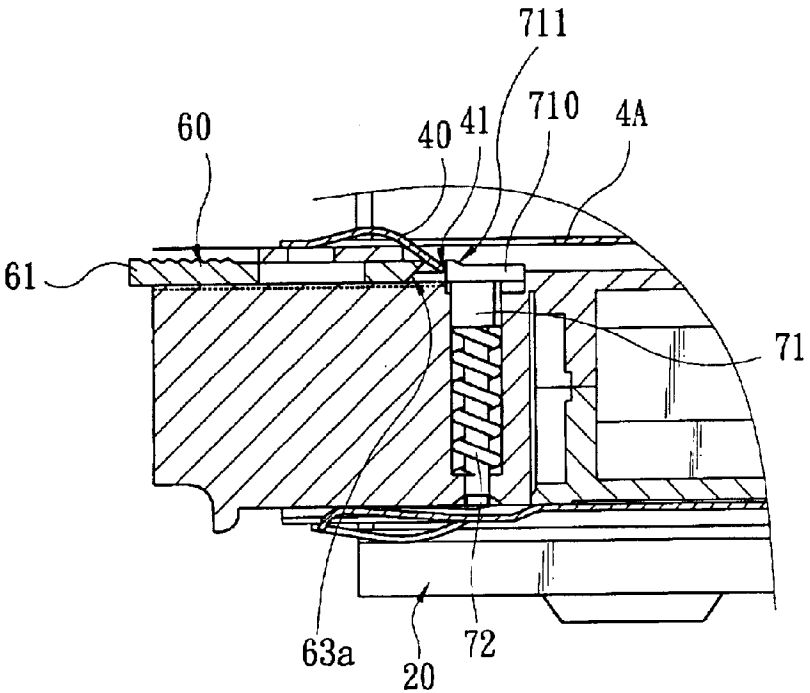

As shown in FIGS. 9A & 9B, the oblique surface 63*a* of the releaser 60 is formed on the side facing the elongated body 71. When the releaser 60 is pushed to the assembling position, the oblique surface 63*a* may push the head 710 of the elongated body 71 into the transceiver 30 so as to separate the head 710 of the elongated body 71 from the stopper 40 for the removal of the transceiver 30.

The Third Embodiment

Figure 10:
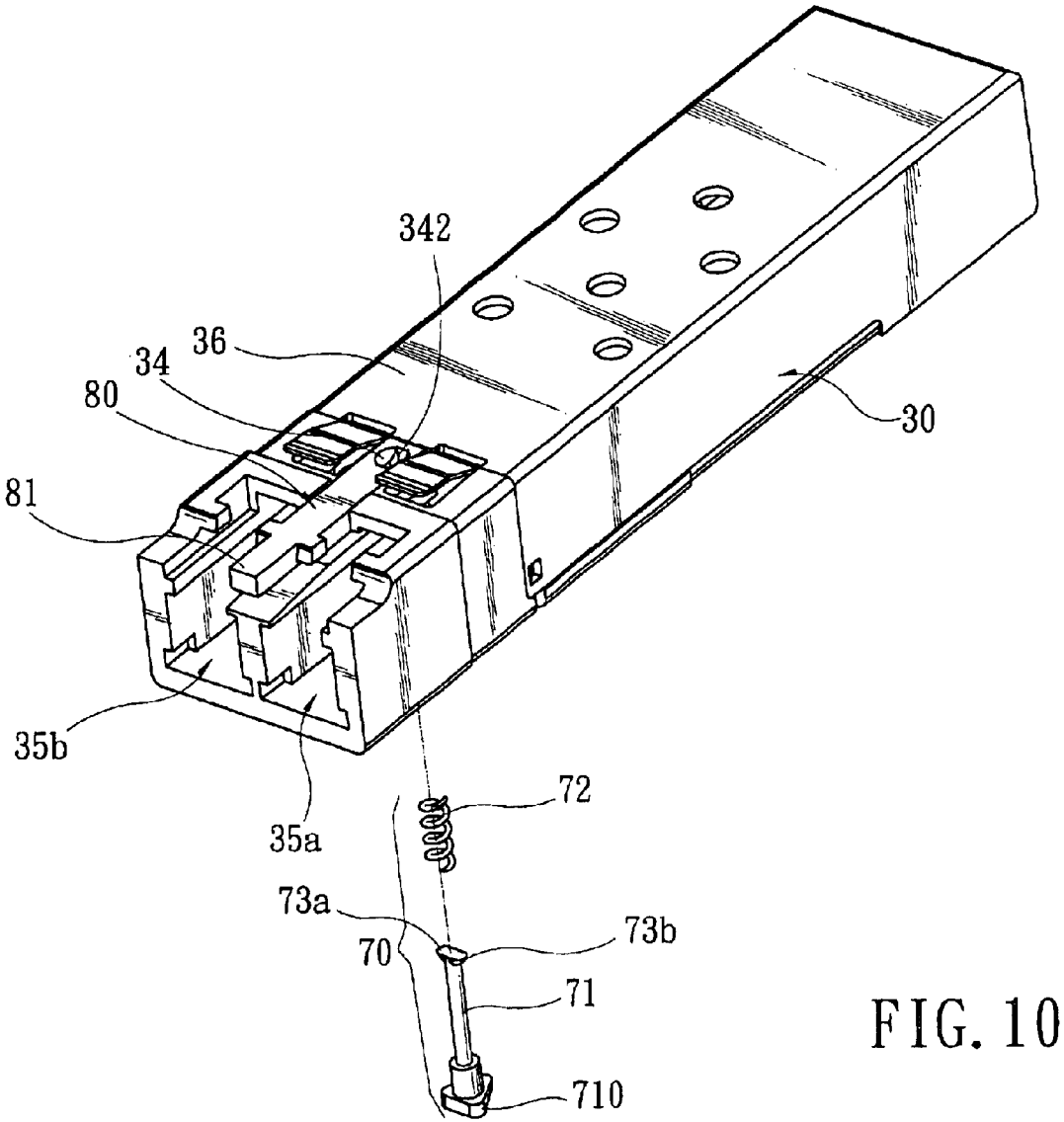
FIG. 10 is a front view of the third embodiment of the invention.
Figure 11:
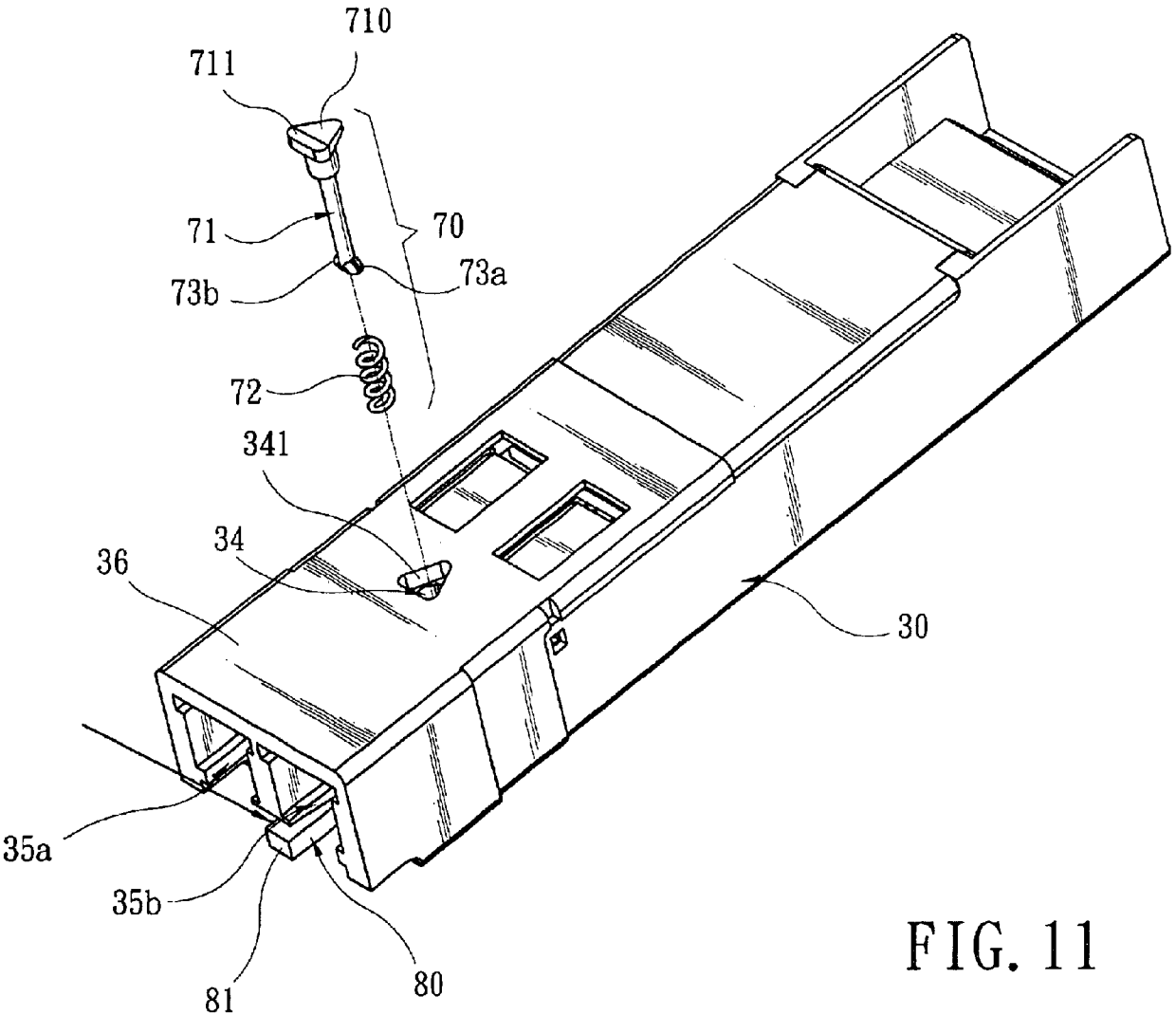
FIG. 11 is a rear view of the third embodiment of the invention.

The third embodiment is similar to the second embodiment except that the aforesaid releaser 60 is replaced by a lever. As shown in FIGS. 10 & 11, an extended lever 80 is installed in the housing 36 of the transceiver 30. One end of the lever 80 is connected to the housing 36 of the transceiver 30, while its other end extends toward the direction of the output/input ends 35*a* and 35*b* of the transceiver 30 to provide an applied end 81. The aforesaid through hole 34 pierces through the lever 80. Hence, by pressing the applied end 81 of the lever 80 along the direction of the arrow shown in FIG. 11, the head 710 of the elongated body 71 can be separated from the stopper 40 for the removal of the transceiver 30.

While the invention is described by way of example and in terms of the aforesaid preferred embodiments, it is to be understood that the invention is not limited thereto. It should be understood that the detailed description and specific examples, while indicating preferred embodiments of the invention, are given by way of illustration only, since various changes and modifications within the spirit and scope of the invention will become apparent to those skilled in the art from this detailed description. Therefore the scope of protection for the invention should conform to the claims attached below.

What is claimed is:

1. A structure for the connection between a hub and a transceiver, comprising:

a stopper installed inside a connection port of the hub;

a fastener installed in the transceiver for engaging with the stopper after the transceiver is inserted into the connection port; and a releaser installed out of the transceiver, slidable between the assembling position and the disassembling position, and including an applied end the releaser having a pair of flexible wings for keeping the releaser in the assembling position in the normal state; when an external force is applied on the applied end, said flexible wings be flexed so that the transceiver will be disassembled from the hub.

2. The structure of claim 1, wherein the stopper has a end fixed in the hub and the other free end flexible and extending obliquely.

3. The structure of claim 1, wherein the ends of the pair of wings extend obliquely along a direction opposite to the insertion direction of the transceiver into the connection port to be coupled with notches on a surface of the transceiver so that the releaser is kept in the assembling position in the normal state.

4. The structure of claim 1, wherein the releaser has an oblique surface facing the stopper for detaching the free end of the stopper from the fastener.

5. The structure of claim 1, wherein the stopper is a metallic spring with one end fixed in the hub and the other end is movable.

6. The structure of claim 1, wherein the free end of the stopper has a hole to be coupled with the fastener.

7. The structure of claim 1, wherein the fastener has an oblique surface on a side facing the stopper, and the oblique surface slides beneath the stopper when the fastener is inserted into the hub.

8. The structure of claim 1, wherein the releaser is inserted into a groove provided on the surface of the transceiver.

9. The structure of claim 8, wherein the groove has a cover.

10. A structure for the connection between a hub and a transceiver, comprising:

a stopper installed inside the connection port of the hub;

a fastener having an elongated body inserted into the transceiver transversely to the longitudinal direction of the transceiver and a spring for raising the elongated body after the transceiver is inserted into the connection port; and a releaser installed out of the transceiver, slidable between the assembling position and the disassembling position, and including an applied end; when an external force is applied on the applied end, the transceiver will be disassembled from the hub.

11. The structure of claim 10, wherein the releaser has an oblique surface facing the elongated body for pushing the head of the elongated body into the transceiver.

12. The structure of claim 10, wherein the stopper is a metallic spring with one end fixed in the hub and the other end which is movable.

13. The structure of claim 10, wherein the head of the elongated body has an oblique surface on a side facing the stopper for sliding beneath the stopper when the fastener is inserted into the hub.

14. The structure of claim 10, wherein the releaser is inserted into a groove provided on the surface of the transceiver.

15. The structure of claim 10, wherein the releaser has a pair of flexible wings for keeping the releaser in the assembling position in the normal state.

16. The structure of claim 15, wherein the ends of the pair of wings extend obliquely along a direction opposite to the insertion direction of the transceiver into the connection port to be coupled with notches on a surface of the transceiver so that the releaser is kept in the assembling position in the normal state.

17. A structure for the connection between a hub and a transceiver, comprising:

a stopper installed inside a connection port of the hub;

a fastener having an elongated body with one end inserted into the transceiver transversely to the longitudinal direction of the transceiver and a spring for raising the elongated body after the transceiver is inserted into the connection port; and a lever connected to a housing of the transceiver, and provided with an applied end, wherein when the applied end of the lever is pressed, the fastener is separated from the stopper for removal of the transceiver.

18. The structure of claim 17, wherein the stopper is a metallic spring with one end fixed in the hub and the other end which is movable.

19. The structure of claim 17, wherein the head of the elongated body has an oblique surface on a side facing the stopper for sliding beneath the stopper when the fastener is inserted into the hub.

* * * * *